United States Patent [19]

Hudson

[11] Patent Number: 4,822,666

[45] Date of Patent: Apr. 18, 1989

[54] RADIATION STABILIZED FABRIC

[75] Inventor: Robert L. Hudson, Roswell, Ga.

[73] Assignee: Kimberly-Clark Corporation, Neenah, Wis.

[21] Appl. No.: 127,739

[22] Filed: Dec. 2, 1987

[51] Int. Cl.[4] ..... B32B 27/00

[52] U.S. Cl. ..... 428/224; 428/290

[58] Field of Search ..... 428/290, 224

[56] References Cited

U.S. PATENT DOCUMENTS 4,041,203 8/1977 Brock et al. ..... 428/157

4,115,605 9/1978 Hultman et al. ..... 427/377

*Primary Examiner*—Marion C. McCamish

*Attorney, Agent, or Firm*—William D. Herrick

[57] ABSTRACT

There is disclosed a radiation stabilized fabric of polypropylene polymer or copolymer of polypropylene. Radiation stabilization results from adding by weight 0.5%–1.0% of a long-chain aliphatic ester, particularly hexadecyl 3,5-di-t-butyl-4-hydroxybenzoate.

5 Claims, No Drawings

RADIATION STABILIZED FABRIC

BACKGROUND OF THE INVENTION

This invention relates generally to radiation stabilized fabrics and more particularly concerns polypropylene nonwoven fabrics that are stabilized against ionizing gamma radiation.

Disposable surgical fabrics for masks, gowns, drapes, towels, and the like are sterilized during manufacture by sealing such surgical products in plastic containers and subjecting the containers to ionizing radiation. During storage the surgical products within the sealed packs retain their sterile condition and are ready to use when the pack is opened.

Because such products are intended to be used once and discarded, the fabrics must be sufficiently low in cost to justify disposal as compared to woven fabrics which can be washed, sterilized, and reused. In producing low cost nonwoven surgical products, polypropylene based fabrics have found wide acceptance because of their advantageous features and cost. A typical example of a surgical fabric is the fabric used in SPUNGUARD® health care products sold by Kimberly-Clark Corporation, the assignee of the present invention. The fabric used in the SPUNGUARD health care products is a three layer laminate of spun-bonded polypropylene, melt-brown polypropylene, and spun-bonded polypropylene forming a fabric having a basis weight of 1.4 ounces per yard square (oz/yd$^2$). Such a fabric has superior technical properties such as bacterial filtration, lint, and strength compared to other nonwoven products.

In order for surgical fabrics to be acceptable in an operating room environment, it is necessary that the fabrics be treated to assure electrical conductivity so that static electricity cannot build up on the surface of the fabrics and produce a spark in the environment of the operating room. Surgical fabrics should also be alcohol repellent. It is also important that surgical fabrics retain a significantly long shelf life to insure that upon removal from a hospital stockroom, the surgical fabric retains all of those advantageous characteristics that it had when it was first manufactured. Finally, it is necessary that the surgical fabric be sterilizable by treatment with gamma radiation without losing its other advantageous features such as its conductivity, strength, and repellency.

SUMMARY OF THE INVENTION

It is therefore an object of the present invention to provide a radiation stabilized polypropylene or copolymer of polypropylene which has been stabilized against the deleterious effects of ionizing radiation.

It is a particular object of the present invention to provide a radiation stabilized fabric which will maintain, with acceptable residual odor, at least 80% of its initial tensile strength after treatment with gamma radiation sufficient to sterilize the fabric and after aging.

It is also an object of the present invention to provide a surgical fabric which can be sterilized by gamma radiation without losing its conductivity and alcohol repellency.

In order to achieve the foregoing objectives, the radiation stabilized fabric of the present invention consists of a nonwoven web of a polypropylene polymer or copolymer of polypropylene which has been treated with a long-chain aliphatic ester particularly hexadecyl 3,5-di-t-butyl-4-hydroxybenzoate. The long-chain aliphatic ester is mixed with the polypropylene polymer or copolymer of polypropylene during the extrusion process prior to the forming of the nonwoven web. The amount of the longchain aliphatic ester is from 0.5% to 1.0% by weight of the resulting web.

Other objects and advantages of the present invention will become apparent upon reading the following detailed description.

DETAILED DESCRIPTION OF THE INVENTION

While the invention will be described in connection with a preferred embodiment and method, it will be understood that I do not intend to limit the invention to that embodiment or method. On the contrary, I intend to cover all alternatives, modifications, and equivalents as may be included within the spirit and scope of the invention as defined by the appended claims.

A surgical fabric made from polypropylene or a polypropylene-ethylene copolymer can be stabilized against the deleterious effects of ionizing radiation by adding a longchain aliphatic ester to the polymer prior to forming the surgical fabric. In one application, the stabilized surgical fabric consists of a laminate of a melt-blown layer of polypropylene fabric sandwiched between two outside layers of spun-bonded polypropylene. The spun-bonded layers may be prepared in accordance with the processes illustrated by the following patents: Dorschner et al. U.S. Pat. No.3,692,618; Kinney U.S. Pat. Nos. 3,338,992 and 3,341,394; Levy U.S. Pat. No. 3,502,538; Hartmann U.S. Pat. Nos. 3,502,763 and 3,909,009; Dobo, et al. U.S. Pat. No. 3,542,615; Morman et al. U.S. Pat. No. 4,405,297; and Harmon Canadian Pat. No.803,714. Spun-bonded materials prepared with continuous filaments generally have at least three common features. First, the polymer is continuously extruded through a spinneret to form discrete filaments. Thereafter, the filaments are drawn either mechanically or pneumatically without breaking in order to molecularly orient the polymer filaments and achieve tenacity. Lastly, the continuous filaments are deposited in a substantially random manner onto the carrier belt to form the web.

The melt-blown interior layer is also conventional and its construction is illustrated by NRL Report 4364, "Manufacture of Super-fine Organic Fibers", by V. A. Wendt, E. L. Boon, and C. D. Fluharty; NRL Report 5265, "An Improved Device for the Formation of Super-Fine Thermoplastic Fibers", by K. D. Lawrence, R. T. Lukas, and J. A. Young; and, U.S. Pat. 3,849,241, issued Nov. 19, 1974, to Buntin, et al.

A surgical fabric consisting of a melt-blown web sandwiched between spun-bonded webs of polypropylene or copolymers of polypropylene can be made in accordance with Brock et al. U.S. Pat. No. 4,041,203 for "Nonwoven Thermoplastic Fabric". Such a fabric is manufactured by Kimberly-Clark Corporation and is used in health care products sold under the mark SPUNGUARD. For such a surgical fabric, it is customary to treat the nonwoven polypropylene or copolymer web with a surface treatment to provide alcohol repellency and enhance conductivity and thereby inhibit the build up of static electricity. In order to achieve alcohol repellency and electrical conductivity a doctor roll is used to apply a mixture comprised by weight of about 2.15% of a polymeric fluorocarbon, 0.09% lithium nitrate, 0.07% hexanol, and 97.06% water to the surface of the fabric. The polymeric fluorocarbon is 3M FC808 manufactured by 3M Company, St. Paul, Minn. The treatment results in a dry add on weight (as a percentage of the web weight) of 0.3 % for the polymeric fluorocarbon and of 0.03% for the lithium nitrate. Such treatment is further described in Hultman et al. U.S. Pat. No. 4,111,605.

As previously discussed, during manufacture surgical fabric is made into surgical products which are sealed in plastic containers and subjected to gamma radiation in order to render the fabric sterile. Polypropylene and copolymers of polypropylene include polypropylene-ethylene copolymers are adversely affected by the radiation and lose strength, lose conductivity, lose repellency, and produce an objectionable odor.

Early attempts at stabilizing polypropylene and its copolymers focused on hindered amine light stabilizers. While hindered amine light stabilizers, such as Chimassorb 944 manufactured by Ciba Geigy Corporation, Hawthorne, N.Y., produce some improvement in stabilization against degradation and strength, they unfortunately cause a loss of conductivity and repellency properties. The mechanism of failure concerning conductivity appears to be a migration of the hindered amine stabilizer to the fiber surface where it chemically and physically interferes with the surface conductivity treatment. Some hindered amine light stabilizers, such as Hostavin TMN 20 manufactured by American Hoescht Corporation, Somerville, N.J., react with the water repellency treatment to form an objectionable nitrate salt deposit on the surgical fabric.

Webs of polypropylene polymer and polypropylene-ethylene copolymer are best stabilized by a long-chain aliphatic ester such as hexadecyl 3,5-di-t-butyl-4-hydroxybenzoate. Particularly, such a benzoate ester is sold under the trademark Cyasorb UV-2908 and is manufactured by American Cyanamid Company, Wayne, N.J. In order to achieve best results, the benzoate ester should be added to the polymer or copolymer in amounts ranging from 0.5% to 1.0% by weight prior to forming the web.

The following examples illustrate the invention:

EXAMPLE 1

The fabric of Example 1 was a control fabric without radiation stabilization.

| | |
|---|---|
| Layer configuration | 3 layer laminate-<br>Spun-bonded<br>Melt-blown<br>Spun-bonded<br>(SMS) |
| Total basis weight | 1.59 oz/yd$^2$ |
| Material | Polypropylene-ethylene copolymer (Shell RWS-6144, Shell Oil Co., Houston, Texas) |
| Static-repellency treatment | mixture by weight of:<br>polymeric fluorocarbon - 2.15% (FC808, 3M Co.)<br>lithium nitrate - 0.09%<br>hexanol - 0.07%<br>water - 97.06%<br>dry added on by weight of web:<br>polymeric fluorocarbon - 0.3%<br>lithium nitrate - 0.03% |
| Stabilization treatment | none |

The fabric exhibited the following characteristics before and after radiation sterilization with 2.5–4.0 megarads of gamma radiation:

| | | | at 120° F. | | | |
|---|---|---|---|---|---|---|
| | Before | After | +30 days | +60 days | +90 days | +180 days |
| Strength (MD/CD ave) | | | | | | |
| grab tensile (lb.) | 21.2 | 10.5 | 4.8 | 1.6 | 0.6 | — |
| (% retained) | | 50 | 23 | 8 | 3 | — |
| trap tear (lb.) | 8.1 | 3.2 | 0.75 | 0.27 | 0.09 | — |
| (% retained) | | 40 | 9 | 3 | 1 | — |
| Odor (0–6) | 0 | 6+ | | | | |
| Static decay (sec.) | 0.04 | 0.04 | 0.06 | 0.65 | 60+ | — |
| Climet lint | 52 | 40 | 383 | 1144 | 264 | — |
| Water repellency | | | | | | |
| impact penetration (grams) | 11.3 | 10.9 | 6.8 | 8.1 | 2.3 | — |
| hydrohead (cm) | 37 | 33 | 31 | 20 | 15 | — |

Example 2

The fabric of Example 2 was made in accordance with the present invention.

| | |
|---|---|
| Layer configuration | 3 Layer laminate-<br>Spun-bonded<br>Melt-blown<br>Spun-bonded<br>(SMS) |
| Total basis weight | 1.55 oz/yd$^2$ |
| Material | Polypropylene (Himont PC-973, Hercules, Inc., Oakbrook, Illinois) |
| Static-repellency treatment | mixture of:<br>polymeric fluorocarbon - 2.15% (FC808, 3M Co.)<br>lithium nitrate - 0.09%<br>hexanol - 0.07%<br>water - 97.06%<br>dry added on by weight of web:<br>polymeric fluorocarbon - 0.3%<br>lithium nitrate - 0.03% |
| Stabilization treatment | 0.5% add on of hexadecyl 3, 5-di-t-butyl-4-hydroxybenzoate (Cyasorb UV-2908) |

The fabric exhibited the following characteristics before and after radiation sterilization with 2.5–4.0 megarads of gamma radiation:

| | | | at 120° F. | | | |
|---|---|---|---|---|---|---|
| | Before | After | +30 days | +60 days | +90 days | +180 days |
| Strength (MD/CD ave) | | | | | | |
| grab tensile (lb.) | 17.3 | 15.0 | 14.0 | 13.3 | 13.5 | — |
| (% retained) | | 87 | 81 | 77 | 78 | 79 |
| trap tear (lb.) | 7.4 | 5.6 | 5.0 | 3.8 | 5.1 | 4.6 |
| (% retained) | | 76 | 67 | 52 | 70 | 62 |
| Odor (0–6) | 0 | 3.3 | | | | |
| Static decay (sec.) | 0.04 | 0.04 | 0.04 | 0.04 | 0.04 | 0.03 |
| Climet lint | 18 | 16 | 8 | 27 | 57 | 58 |

Example 3

The fabric of Example 3 was made in accordance with the present invention.

| | |
|---|---|
| Layer configuration | 3 layer laminate-<br>Spun-bonded<br>Melt-blown<br>Spun-bonded<br>(SMS) |
| Total basis weight | 1.60 oz/yd$^2$ |
| Material | Polypropylene (Himont PC-973, Hercules, Inc., Oakbrook, Illinois) |
| Static-repellency treatment | mixture of:<br>polymeric fluorocarbon - 2.15%<br>lithium nitrate - 0.09%<br>hexanol - 0.70%<br>water - 97.06%<br>dry add on by weight of web:<br>polymeric fluorocarbon - 0.03%<br>lithium nitrate - 0.03% |
| Stabilization treatment | 0.7% add on of Cyasorb UV-2908 |

The fabric exhibited the following characteristics before and after radiation sterilization with 2.5–4.0 megarads of gamma radiation:

| | | | at 120° | | | |
|---|---|---|---|---|---|---|
| | Before | After | +30 days | +60 days | +90 days | +180 days |
| Strength (MD/DC ave) | | | | | | |
| grab tensile (lb.) | 19.2 | 14.3 | 15.7 | 16.2 | 14.5 | — |
| (% retained) | | 75 | 77 | 85 | 76 | — |
| trap tear (lb.) | 6.1 | 4.0 | 3.9 | 3.7 | 3.6 | — |
| (% retained) | | 66 | 65 | 63 | 60 | — |
| Odor (0–6) | 0 | 2.0 | | | | |
| Static decay (sec.) | 0.04 | 0.04 | 0.04 | 0.04 | 0.04 | — |
| Climet lint | 71 | 31 | 44 | 77 | 40 | — |
| Water repellency | | | | | | |
| impact penetration (grams) | 0.6 | 0.6 | 1.1 | 1.0 | 0.4 | — |
| hydrohead (cm) | 55 | 63 | 52 | 46 | 52 | — |

EXAMPLE 4

The fabric of Example 3 was made in accordance with the present invention.

| | |
|---|---|
| Layer configuration | 3 layer laminate-<br>Spun-bonded<br>Melt-blown<br>Spun-bonded<br>(SMS) |
| Total basis weight | 1.55 oz/yd$^2$ |
| Material | Polypropylene (Himont PC-973, Hercules, Inc., Oakbrook, Illinois) |
| Static-repellency treatment | mixture of:<br>polymeric fluorocarbon - 2.15%<br>lithium nitrate - 0.09%<br>hexanol - 0.70%<br>water - 97.06%<br>dry add on by weight of web:<br>polymeric fluorocarbon - 0.3%<br>lithium nitrate - 0.03% |
| Stabilization treatment | 0.7% add on of Cyasorb UV-2908 |

The fabric exhibited the following characteristics before and after radiation sterilization with 2.5–4.0 megarads of gamma radiation:

| | | | at 120° F. | | | |
|---|---|---|---|---|---|---|
| | Before | After | +30 days | +60 days | +90 days | +180 days |
| Strength (MD/CD ave) | | | | | | |
| grab tensile (lb.) | 23.4 | 19.0 | 18.5 | — | — | — |
| (% retained) | | 82 | 79 | — | — | — |
| trap tear (lb.) | 8.2 | 7.5 | 6.6 | — | — | — |
| (% retained) | | 93 | 80 | — | — | — |
| Odor (0–6) | 0 | 2.9 | | | | |
| Static decay (sec.) | 0.04 | 0.04 | 0.04 | — | — | — |
| Climet lint | — | 36 | 49 | — | — | — |
| Water repellency | | | | | | |
| impact penetration (grams) | 0.7 | 2.9 | 0.25 | — | — | — |
| hydrohead (cm) | 46.8 | 42.5 | 46.7 | — | — | — |

In the examples the grab tensile strength was the machine direction and cross direction average measured in accordance with Federal Test Method (FTM) 191A. The trap tear strength was the machine direction and cross direction average determined in accordance with ASTM D1117-14. Static decay was measured in accordance with FTM 191B, Method 4046. Climet lint, which reports the number of lint particles greater than 0.5 microns that slough off of the material, was measured in accordance with Inda 160.0-83. Impact penetration was measured in accordance with AATCC 42. Hydrohead was determined in accordance with FTM 191A, Method 5514. Odor was a subjective test carried out by panels or 4 people who rated the odor level from 0 (no odor) to 6 (odor from the unstabilized fabric).

I claim:

1. A radiation stabilized fabric comprising a nonwoven web formed of a propylene polymer containing a long-chain aliphatic ester of a 3,5-di-t-butyl-4-hydroxybenzoic acid.

2. The fabric of claim 1, wherein the long-chain aliphatic ester is hexadecyl 3,5-di-t-butyl-4-hydroxybenzoate.

3. The fabric of claim 1 wherein the propylene polymer is polypropylene.

4. The fabric of claim 1 wherein the propylene polymer is a propylene-ethylene copolymer.

5. The fabric of claim 1, 2, 3, or 4, wherein the long-chain aliphatic benzoate ester is present in the web in an amount of 0.5%–1.0% by weight of the web

* * * * *